US007318941B2

(12) United States Patent
Poupard et al.

(10) Patent No.: US 7,318,941 B2
(45) Date of Patent: Jan. 15, 2008

(54) ASSEMBLY COMPRISING A PACKAGE AND A PROCESSED CHEESE PORTION

(75) Inventors: Corinne Poupard, St Germain les Arlay (FR); Jean-Claude Weber, Bondy (FR)

(73) Assignee: Fromageries Bel, Paris (FR)

( * ) Notice: Subject to any disclaimer, the term of this patent is extended or adjusted under 35 U.S.C. 154(b) by 118 days.

(21) Appl. No.: 10/169,377

(22) PCT Filed: Jan. 5, 2001

(86) PCT No.: PCT/FR01/00035

§ 371 (c)(1),
(2), (4) Date: Jul. 2, 2002

(87) PCT Pub. No.: WO01/49586

PCT Pub. Date: Jul. 12, 2001

(65) Prior Publication Data

US 2003/0017237 A1 Jan. 23, 2003

(30) Foreign Application Priority Data

Jan. 7, 2000 (FR) ..... 00 00194

(51) Int. Cl.
*B65D 85/00* (2006.01)

(52) U.S. Cl. ..... 426/122; 426/130

(58) Field of Classification Search ..... 426/130, 426/122, 123, 112, 115, 106; 229/87.05, 229/87.08, 87.09, 87.11; 206/551
See application file for complete search history.

(56) References Cited

U.S. PATENT DOCUMENTS

| | | | | | |
|---|---|---|---|---|---|
| 3,179,326 | A | * | 4/1965 | Underwood et al. | 229/203 |
| 3,412,927 | A | * | 11/1968 | Baur | 229/87.05 |
| 3,924,803 | A | * | 12/1975 | de Habsburg | 229/87.05 |
| 4,801,075 | A | * | 1/1989 | Weber et al. | 229/87.05 |
| 5,024,331 | A | * | 6/1991 | Litzler | 206/551 |
| 5,188,285 | A | * | 2/1993 | Nilsson et al. | 229/242 |
| 5,613,779 | A | | 3/1997 | Niwa | |
| 5,630,308 | A | | 5/1997 | Guckenberger | |
| 5,839,648 | A | * | 11/1998 | Brigand et al. | 229/87.05 |
| 6,006,907 | A | * | 12/1999 | Sato et al. | 206/387.1 |

FOREIGN PATENT DOCUMENTS

| | | | |
|---|---|---|---|
| DE | 3641539 | A * | 6/1987 |
| EP | 0 057 644 | | 8/1982 |
| FR | 2 686 325 | | 7/1993 |
| GB | 1166242 | A * | 10/1969 |
| GB | 1427091 | A * | 3/1976 |
| JP | 10059320 | A * | 3/1998 |

* cited by examiner

*Primary Examiner*—Timothy F. Simone
(74) *Attorney, Agent, or Firm*—Young & Thompson

(57) ABSTRACT

An assembly including a processed cheese portion (22) and a package (26) closely wrapping the portion. The package includes an element which itself comprises a film (2) tightly wrapping the portion and in contact therewith, and tear-initiating member (11) for enabling the sheet (2) to be torn along at least one tear line (8) when a gripping tab (10) of the element is pulled. At least a first part of the or each tear line (8) is defined by or made from a material of the film (2).

19 Claims, 5 Drawing Sheets

ASSEMBLY COMPRISING A PACKAGE AND A PROCESSED CHEESE PORTION

Figure 1:
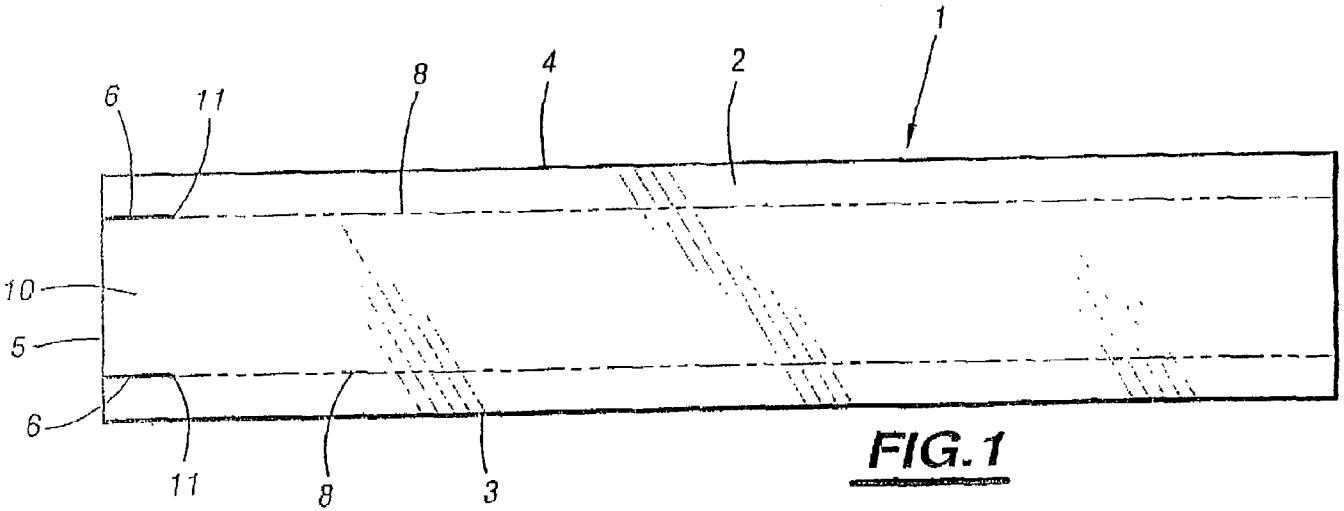

The present invention relates to an assembly comprising a processed cheese portion and a package closely wrapping said portion, the package comprising an element itself comprising a film, which closely wraps said portion and is in contact therewith, and means for initiating a tear so that the film tears along at least one tear line when a gripping tab of the element is pulled.

Processed cheeses are to be understood as being the products obtained by the hot melting, in the presence or absence of melting salts, of cheeses on their own or in admixture with other dairy raw materials (butter, milk powder, lactoserum, anhydrous milk fats, protein concentrates, etc.). The term processed cheese also includes products in which the cheese raw materials or dairy raw materials have been replaced wholly or partially by vegetable materials (fats or proteins).

In general, processed cheese portions, which are of a pasty consistency, are closely packed in packages produced from a plurality of elements which comprise aluminium films.

As is described, for example, in the documents EP-242 268 and EP-340 093, in an assembly of the type mentioned above, an element of the package usually comprises a film and a tearing member attached to the film by welding. One end of the tearing member extends beyond the film to form the gripping tab.

The tearing member strengthens the film locally, although, when a consumer pulls the gripping tab, it allows tearing of the film to begin along the outer edges of the tearing member. When the consumer continues to pull the gripping tab, the tearing member guides along its outer edges the tears in the film so begun. Such tearing members are generally relatively long in order to allow the tears to be guided over the entire length of the tear lines.

Although the opening of such packages is generally satisfactory, their production presents a number of problems, including those associated with the cutting, positioning and welding of the tearing members on the films of the packaging elements.

In fact, the shape and positioning of the tearing members on the packaging elements must be relatively precise in order for the opening of the packages formed to be satisfactory.

An object of the invention is, therefore, to provide an assembly of the above-mentioned type which is more simple and more economical to produce.

To that end, the invention relates to an assembly of the type mentioned above, characterised in that at least a first portion of said or of each tear line is defined by or in a material of the film.

According to particular embodiments, the assembly may have one or more of the following features, taken in isolation or in accordance with all the technically possible combinations:

- the film comprises a material whose resistance to tearing in the direction of the or of each first tear line portion is lower than its resistance to tearing in a direction orthogonal to the direction of the or of each first tear line portion;
- said material is a material oriented principally according to the direction of the or of each first tear line portion;
- a line of lesser resistance is formed in the film substantially along the or each first tear line portion;

- the or each line of lesser resistance is a line obtained by damaging the film by means of a laser beam;
- the or each line of lesser resistance is a line obtained by damaging the film mechanically by means of a tool;
- the gripping tab is formed at least partly by a portion of the film;
- the initiating means comprise at least one cut formed in the film close to the gripping tab and at one end of the or of each first tear line portion;
- the film has two tear lines whose first portions are substantially parallel and at a distance from one another, the two first portions delimiting between them, in the film, at least part of a tearable strip terminated by the gripping tab;
- the package comprises a substantially cylindrical sleeve, a base and a cover which close the sleeve at its lower and upper ends; and
- said packaging element forms at least said sleeve, said or each first tear line portion extending in the vicinity of the base or of the cover.

Figure 5:
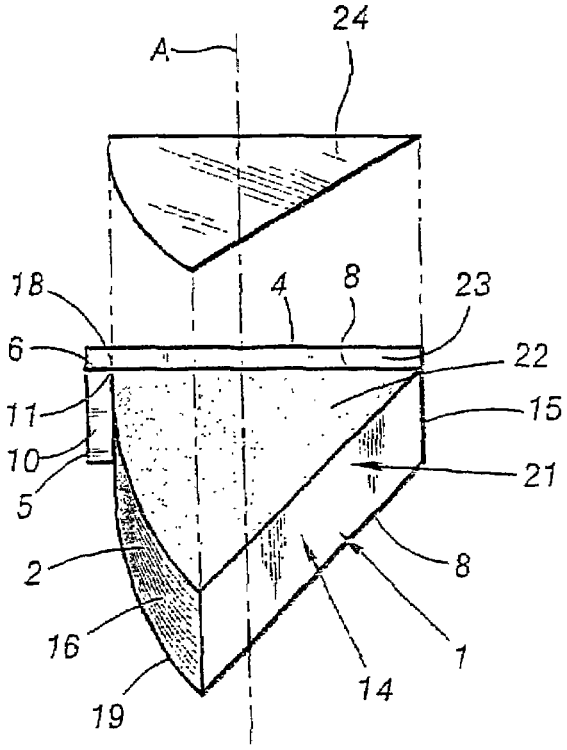
Figure 6:
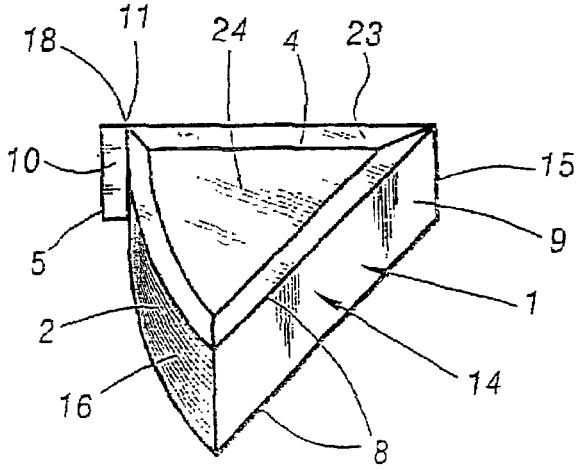
Figure 7:
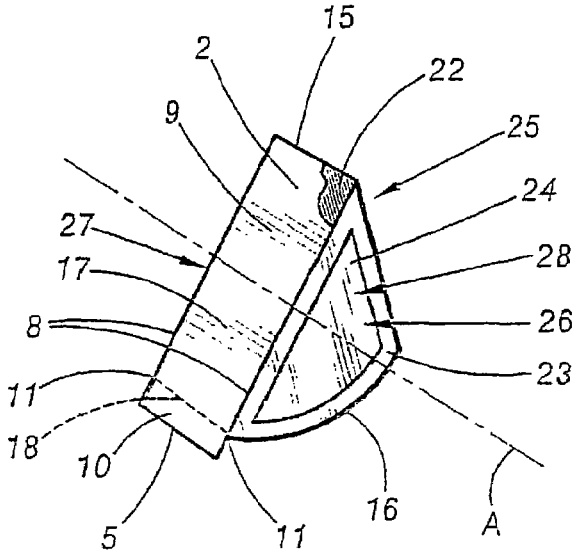
Figure 8:
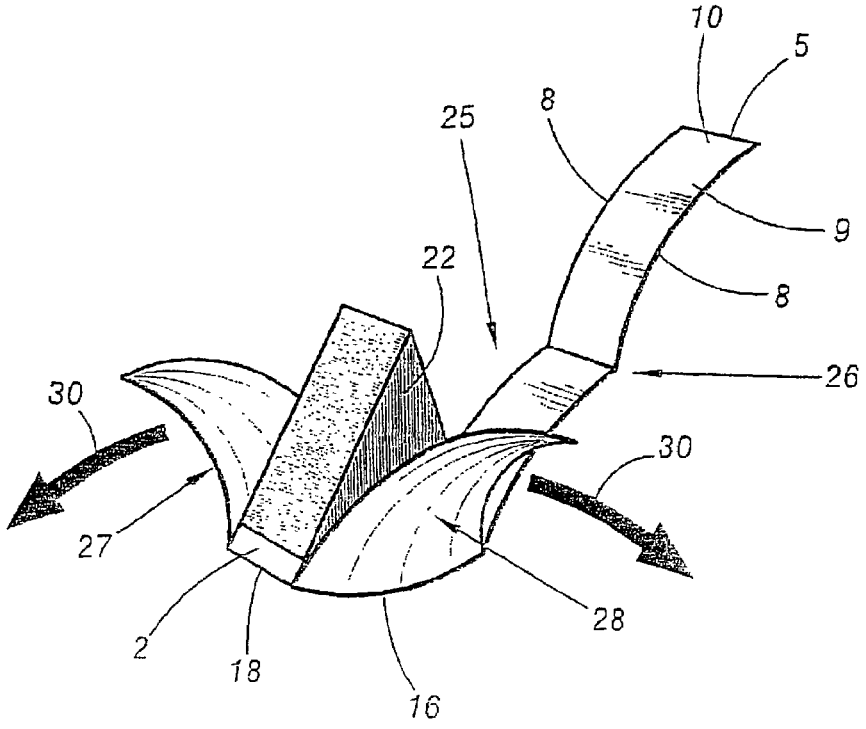
Figure 9:
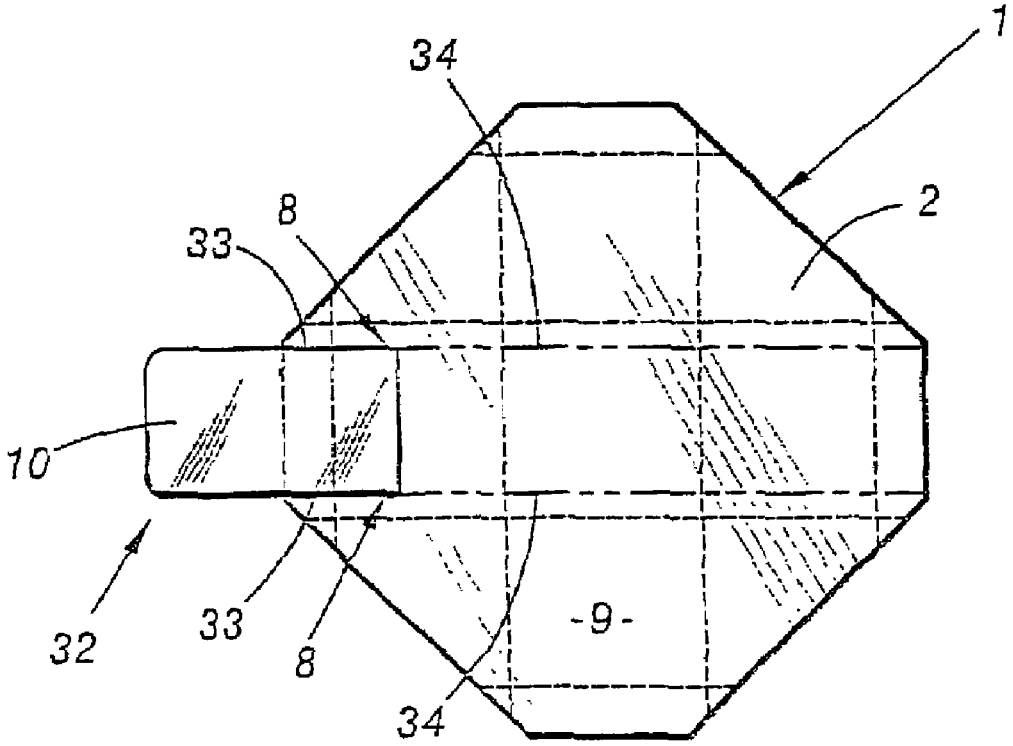

The invention will be better understood upon reading the following description, which is given solely by way of example and refers to the attached drawings, in which:

FIG. 1 is a top view of an element according to the invention,

FIGS. 2 to 6 are diagrammatic perspective views showing the successive steps of a process for packing a processed cheese portion starting from the element of FIG. 1, FIG. 7 is a diagrammatic perspective view, partially cut away, showing the assembly comprising the processed cheese portion and the package so obtained, FIG. 8 is a diagrammatic perspective view, partially cut away, showing the opening of the package of FIG. 7, FIG. 9 is a view analogous to FIG. 1 showing another embodiment of the invention.

FIG. 1 shows an element 1 for forming a package for the packing of a processed cheese portion.

The element 1 is constituted by a rectangular film 2 lengthened according to a longitudinal direction. The film 2 is made, for example, of a material which is oriented in principle longitudinally, that is to say parallel to the long sides 3 and 4 of the film 2.

The film 2 thus offers resistance to tearing in its longitudinal direction which is lower than its resistance to tearing in its transverse direction.

As a result, the film 2 has the property of tearing, once tearing has begun, preferentially in a substantially rectilinear manner along its longitudinal direction.

Starting from the left-hand short side 5 of the film 2, longitudinal slits 6 of short length have been formed. The slits 6 have a length of, for example, from 1 to 3 mm.

The slits 6 are at a distance from one another transversely and are advantageously arranged symmetrically relative to the median longitudinal axis of the film 2. The slits 6 are each arranged at a small distance from one of the long sides 3 and 4 of the film 2.

Owing to the orientation of the material of the film 2, the longitudinal lines 8 (shown by double-dot and dash lines in FIG. 1), which prolong the slits 6 in the film 2, are predetermined tear lines of the element 2.

The tear lines 8 delimit between them a central and longitudinal strip 9 which forms, between the slits 6, a gripping tab 10 of rectangular shape. The inner ends 11 of the slits 6 delimit the inner corners of the gripping tab 10.

Figure 2:
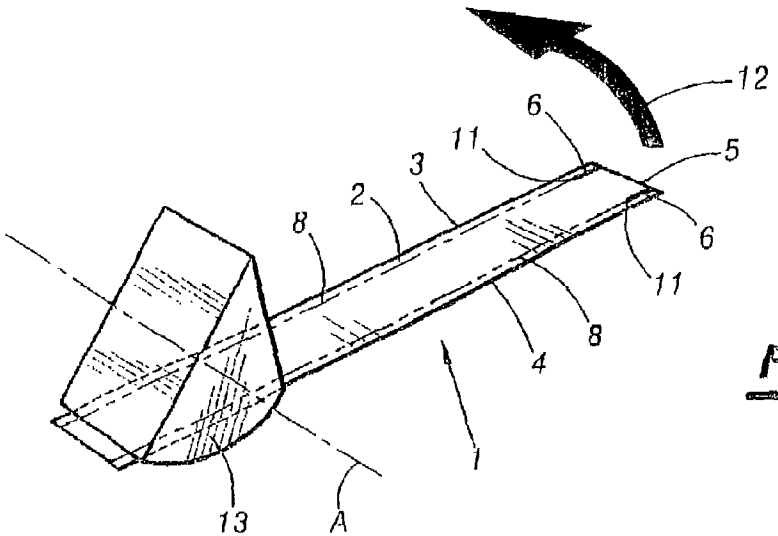

In order to form a package for packing a processed cheese portion, the element 1 will be wound, as illustrated by the arrow 12 in FIG. 2, round a mandrel 13 of cylindrical shape having an axis A and a base in the form of a disk segment.

Figure 3:
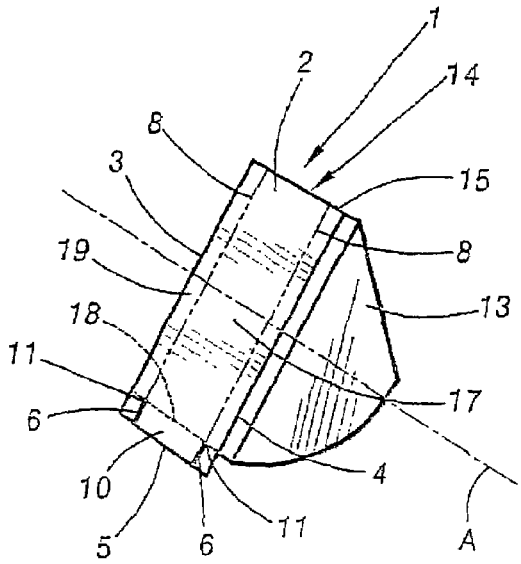
Figure 4:
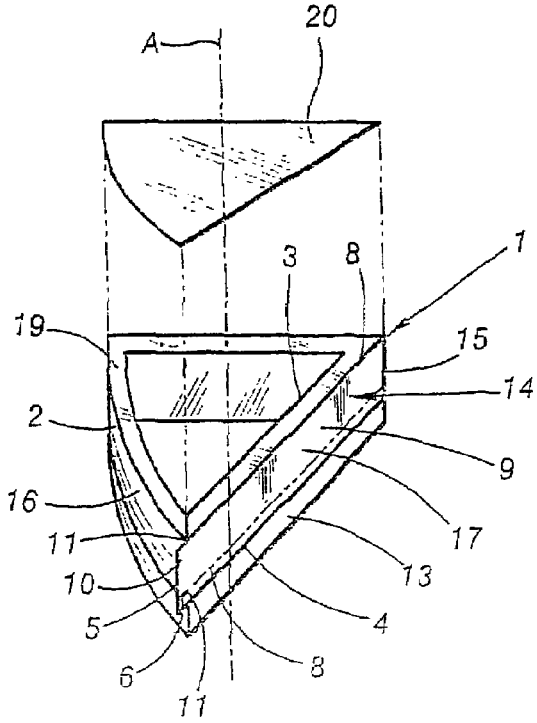

In that manner there is obtained a sleeve 14 of corresponding shape, shown in FIGS. 3 and 4. The sleeve 14 has a tip 15 and a curved heel 16. The element 1 covers itself in the region of the heel 16 over a small portion of the length of a lateral face 17 of the sleeve 14, the face 17 connecting the tip 15 to the heel 16. The short side 5 of the film 2 is located in the extension of the lateral face 17 beyond the edge 18 connecting the heel 16 to the lateral face 17. In that manner, the gripping tab 10 projects relative to the sleeve 14, beyond the edge 18, in the prolongation of the lateral face 17.

The mandrel 13 is then gently removed axially from the sleeve 14 so that the edge 19 of the sleeve 14, delimited by the long side 3 of the film 2 and the adjacent tear line 8, extends beyond the mandrel 13.

As is shown in FIG. 4, the edge 19 of the sleeve 14 is then turned down on the mandrel 13 by folding substantially along the adjacent tear line 8.

A base panel 20, having the shape of a disk segment corresponding to that of the mandrel 13, will then be sealed to the turned-down edge 19 of the sleeve 14. The panel 20 is made, for example, of the same material as the film 2.

A cup 21, shown in FIG. 5 after rotation relative to FIG. 4, and after complete axial withdrawal of the mandrel 13, is thus obtained.

The cup 21 is then partly filled with processed cheese 22, leaving the upper edge 23 of the sleeve 14, delimited by the long side 4 of the film 2 and the adjacent tear line 8, to extend beyond the upper surface of the cheese 22 contained in the cup 21.

The processed cheese 22 then forms a portion of cylindrical shape having an axis A and a base in the form of a disk segment, contained within the cup 21.

A covering panel 24 having the shape of a disk segment corresponding to that of the mandrel 13 will then be introduced into the upper free end of the sleeve 14. The panel 24 is made, for example, of the same material as the film 2. The covering panel 24 is then applied to the upper surface of the processed cheese portion 22.

As is shown in FIG. 6, the upper edge 23 of the sleeve 14 is then turned down on the covering panel 24 by folding the film 2 substantially along the adjacent tear line 8. The edge 23 is then sealed to the covering panel 24. In a variant which is not shown, sealing of the covering panel 24 to the sleeve 14 is carried out by sealing an edge of the panel 24, folded outwards, to the edge 23, for example with the aid of sealing jaws which are movable radially relative to the axis A. The base panel 20 can also be sealed in an analogous manner to the sleeve 14 to form the cup 21.

As is shown in FIG. 7, there is thus obtained an assembly 25 comprising a package 26 and a processed cheese portion 22 which is closely wrapped by the package 26 and is visible thanks to the cutaway of FIG. 7. The package 26, and in particular the central strip 9 of the film 2, is in direct contact with the portion 22. The package 26 is cylindrical in shape with an axis A and a base in the form of a disk segment. That shape is delimited by the central strip 9 of the film 2, closed at its ends by a base 27, formed by the edge 19 of the film 2 and by the base panel 20, and by a cover 28 formed by the edge 23 of the film 2 and by the cover panel 24.

In order to open the package 26 and allow access to the processed cheese portion 22, a consumer may, for example, grip the package 26 between his left thumb and his left index finger, which rest on the cover 28 and on the base 27, respectively, the heel 16 then being directed towards the consumer's left palm.

It is then very easy for the consumer to grip the gripping tab 10 between his right thumb and his right index finger and then pull it towards the tip 15 of the package 26. Two tears begin at the corners 11 of the gripping tab 10. Those tears are then propagated substantially along the tear lines 8. In that manner, the consumer is able to tear the central strip 9 on the two lateral faces of the package 26.

The consumer then simply has to remove the base 27 and the cover 28, as is shown by the arrows 30 in FIG. 8, and finally the heel 16 in order to be able to consume the processed cheese portion 22.

Opening of the package 26 is, therefore, relatively simple.

Moreover, it will be seen that the element 1, which is constituted by only a single film 2, is relatively simple and economical to produce. In fact, the element 1 does not require the attachment of a tearing member to the film 2. In that manner, all the problems associated with such a member are eliminated.

In particular, it is not necessary either to use a plurality of materials to form the element 1 or to provide specific equipment for cutting, positioning and welding a tearing member to the film 2. Moreover, the risks of faulty opening associated with incorrect positioning or a poor shape of the tearing member, and with breaking of that member, are eliminated.

The invention may, of course, be applied to packages of shapes other than those shown. In particular, the packages may be of cylindrical shape with a square, rectangular, circular, etc. base.

According to another alternative, the package 26 may be constituted by two elements, a first of those elements forming a cup and the second element forming a base for sealing the upper free end of the cup. The first element then comprises a film whose structure is suitable for ensuring the initiation and propagation of tears along predetermined tear lines.

It is thus possible, for example, to use the invention in the case of packages such as those described in the documents EP-242 268, EP-340 093 and FR-2 499 025.

The materials constituting the films of the various elements of one and the same package may be different.

The film 2 may be made, for example, of mono-oriented polyethylene, such as that marketed by Mobil under the registered trade mark "HICOR".

More generally, the film 2 is, for example, a film of a plastics material extruded according to the longitudinal direction of the film 2. The fibres or polymer chains of the film 2 are therefore oriented for the majority along the extrusion direction, that is to say along the longitudinal direction of the film 2.

Still more generally, the film may comprise several layers of materials of which at least one is a material oriented principally in the longitudinal direction of the film 2.

Accordingly, the mono-oriented polyethylene "HICOR" can be complexed with other polymers, oriented or not, such as oriented polypropylene, polyethylene terephthalate or polyamide.

According to another variant, which may be combined with those described above, the lines 8 may be lines of lesser resistance formed in the film 2 by damaging at least one of its surfaces. That damage can be obtained, for example, by marking with the aid of a laser beam or by mechanical marking with the aid of a tool such as, for example, a roller.

In that case too, the film 2 is therefore designed to tear by itself along at least a portion of the tear lines.

According to another variant, which is not shown, each slit 6 may be paired with another adjacent and parallel slit 6. This variant makes it possible to reduce the risks of faulty opening of the package 26, for example in the case where one of the slits 6, owing to its position, is unable to initiate a tear which is propagated in a satisfactory manner in the package 26.

According to yet another embodiment, the portion of the central strip 9 forming the gripping tab 10 is covered with a reinforcing and gripping member having the same rectangular shape, which member will participate in the initiation of tears which will subsequently be propagated along the lines 8. More generally, the gripping tab may be formed at least partly by a reinforcing and gripping member attached at the level of the tear initiation zone.

That embodiment is of interest especially in the case where the gripping tab is located in the vicinity of the tip 15 of the package 26.

In that case, the manufacturing constraints associated with the presence of that reinforcing and gripping member are less important than for conventional tearing members. In fact, the reinforcing and gripping member ensures or participates in the initiation of tears but does not guide them over the entire length of the tear lines.

That embodiment can likewise be applied to the production of packages such as that of the document EP-340 093, as shown in FIG. 9, which corresponds to FIG. 1 of the document EP-340 093, the tear lines 8 being straight. In that case, the reinforcing and gripping member 32 ensures the initiation of tears and the guiding thereof in the initial portions 33 of the tear lines 8. The film 2 then itself serves to guide the tears along the straight terminal portions 34 of the tear lines 8, owing to the design of the film 2 which comprises, for example, a material oriented in principle parallel to those portions 34 of the lines 8.

The invention claimed is:

1. An assembly comprising a processed cheese portion and a package closely wrapping said portion, said package comprising an element itself comprising a film, which closely wraps said portion and is in contact therewith, and means for initiating a tear so that the film tears along at least one tear line when a gripping tab of the element is pulled, at least a first portion of said at least one tear line is defined by or in a material of the film itself, before the film is folded to wrap the portion, wherein the film comprises a material, the material having before being folded a resistance to tearing in the direction of the first portion of the tear line is lower than its resistance to tearing in a direction orthogonal to the direction of the first tear line portion, and wherein the element is not provided with an additional tear strip extending along the whole length of the tear line.

2. The assembly according to claim 1, wherein the package comprises a substantially cylindrical sleeve, a base and a cover which close the sleeve at its lower and upper ends.

3. The assembly according to claim 2, wherein said packaging element forms at least said sleeve, said first portion of the tear line extending in the vicinity of the base or of the cover.

4. The assembly according to claim 1, wherein said material is a material oriented principally in the direction of the or first portion of the tear line.

5. The assembly according to claim 1, wherein the gripping tab is formed at least partly by a portion of the film.

6. The assembly according to claim 1, wherein the initiation means comprise at least one cut formed in the film close to the gripping tab and at one end of the first portion of the tear line.

7. The assembly according to claim 1, wherein the element is not provided with an additional tear strip.

8. An assembly comprising a processed cheese portion and a package closely wrapping said portion, said package comprising an element itself comprising a film, which closely wraps said portion and is in contact therewith, and means for initiating a tear so that the film tears along at least one tear line when a gripping tab of the element is pulled, at least a first portion of said tear line is defined by a line of lesser resistance formed in the film before folding of the film to wrap the portion, and wherein the element is not provided with an additional tear strip extending along the whole length of the tear line.

9. The assembly according to claim 8, wherein the line of lesser resistance is a line obtained by damaging the film by means of a laser beam.

10. The assembly according to claim 8, wherein the line of lesser resistance is a line obtained by mechanically damaging the film by means of a tool.

11. The assembly according to claim 8, wherein the gripping tab is formed at least partly by a portion of the film.

12. The assembly according to claim 8, wherein the initiation means comprise at least one cut formed in the film close to the gripping tab and at one end of the first portion of the tear line.

13. The assembly according to claim 8, wherein the package comprises a substantially cylindrical sleeve, a base and a cover which close the sleeve at its lower and upper ends.

14. The assembly according to claim 8, wherein said packaging element forms at least said sleeve, said first portion of the tear line extending in the vicinity of the base or of the cover.

15. An assembly comprising a processed cheese portion and a package closely wrapping the portion, the package comprising a film, which closely wraps the portion and is in contact therewith, and wherein the film comprises:

i) a gripping tab formed at least partly by a portion of the film, ii) at least one tear line, and iii) at least one cut formed in the film close to the gripping tab and at one end of the tear line, so that the film tears along at the tear line when the gripping tab is pulled, and wherein a first portion of the tear line is defined by or in the material of the film itself, wherein said material has a resistance to tearing in the direction of the first portion of the least one tear line that is lower than its resistance to tearing in a direction orthogonal to the direction of the first tear line portion, and wherein the film is not provided with an additional tear strip extending along the whole length of the tear line.

16. The assembly according to claim 15, wherein the package comprises a substantially cylindrical sleeve, a base and a cover which close the sleeve at its lower and upper ends.

17. The assembly according to claim 15, wherein the material is a material oriented principally in the direction of the first portion of the tear line.

18. The assembly according to claim 15, wherein the tear line is defined by a line of lesser resistance formed in the film before folding of the film to wrap the portion.

19. An assembly comprising a processed cheese portion and a package closely wrapping the portion, the package comprising a film, which closely wraps the portion and is in contact therewith, and wherein the film comprises:

i) a gripping tab, ii) at least one tear line, and iii) at least one cut formed in the film close to the gripping tab and at one end of the tear line, so that the film tears along at the tear line when the gripping tab is pulled, and wherein a first portion of the tear line is defined by or in the material of the film itself, wherein said material has a resistance to tearing in the direction of the first portion of the least one tear line that is lower than its resistance to tearing in a direction orthogonal to the direction of the first tear line portion, and wherein the film is not provided with a tear strip extending along the whole length of the tear line.

* * * * *